US006402148B1

(12) United States Patent
Saruwatari

(10) Patent No.: US 6,402,148 B1
(45) Date of Patent: Jun. 11, 2002

(54) METHOD OF PLAYING A CASINO CARD GAME

(76) Inventor: Hank Saruwatari, P.O. Box 687, Hotchkiss, CO (US) 81419

( * ) Notice: Subject to any disclaimer, the term of this patent is extended or adjusted under 35 U.S.C. 154(b) by 0 days.

(21) Appl. No.: 09/765,892

(22) Filed: Jan. 18, 2001

(51) Int. Cl.[7] ..... A63F 1/00
(52) U.S. Cl. ..... 273/292
(58) Field of Search ..... 273/292, 303–306, 273/309; 463/12, 13

(56) References Cited

U.S. PATENT DOCUMENTS 5,377,993 A * 1/1995 Josephs
5,660,393 A * 8/1997 Dreger
6,131,908 A * 10/2000 Palimer
6,203,018 B1 * 3/2001 Osuch
6,270,079 B1 * 8/2001 Chamberlain

* cited by examiner

*Primary Examiner*—Benjamin H. Layno
(74) *Attorney, Agent, or Firm*—Robert Ryan Morishita; Anderson & Morshita

(57) ABSTRACT

A method for playing a game between a player and a dealer using a standard deck of playing cards is played on a table having a plurality of player positions. Each player makes a first and second wager and the dealer deals one card to each occupied and unoccupied player positions and to the dealer. Optionally, the dealer receives two cards. First wagers are resolved by comparing the card at each occupied player position to the dealer card and rewarding players having a card outranking the dealer card. Optionally, an automatically winning card, supplemental wagers, and insurance wagers may be provided. After resolving all first wagers, a community hand is formed using all cards dealt to the occupied and unoccupied player positions and the dealer card. The community hand is compared to a predetermined schedule of winning hands and rewards are issued to each player based on the player's second wager if the community hand is a winning hand.

14 Claims, 3 Drawing Sheets

METHOD OF PLAYING A CASINO CARD GAME

FIELD OF THE INVENTION

The present invention is a method for playing a card game between a player and a dealer. Specifically, the present invention is a card game in which players place two wagers: a wager on the outcome of a game against the dealer and a wager on a community hand formed from all the player's cards and the dealer card against a predetermined schedule of winning hands.

BACKGROUND OF THE INVENTION

It is well known in the art that two major factors affect the profitability of a casino game. One is the house advantage and the other is the "action" or quantity of hands that can be played in a specified period of time. In jurisdictions in which the house advantage is set by gaming regulation, casinos seeking to increase profitability are limited to increasing the action of existing games or finding new games in which a large number of hands can be dealt in a specified period of time.

An example of a common card game that a large number of hands can be dealt in a specified period of time is Blackjack. In Blackjack, players attempt to form a hand with a final hand total as close to twenty-one as possible without exceeding twenty-one. When calculating the final hand total, each card has a value equal to its face value except face cards, which have a value of ten, and aces, which may have a value of eleven or one, as the player selects.

Play of Blackjack begins with each player making a wager in a wagering area on a playing surface. The dealer deals two cards to each player and two cards, one card face up and the other face down, to himself. Any player receiving a total of twenty-one in the initial dealt hand, referred to as a "natural" or Blackjack, is rewarded, typically at a rate of 2:1 or 3:2, and play is terminated as to that player. Remaining players examine their hands and "hit," i.e. receive another card, or "stand," i.e. stand on the player's current hand total. If the player hits and receives a card which causes his hand total to exceed twenty-one, the player busts and the player's wager is immediately collected and play is terminated as to that player. A player may hit as many times as the player wishes as long as the player does not bust.

A player may also have additional options available depending on the initial hand dealt. If a player receives a predetermined sum, the player may have the option to "double down." Although the availability of the double down option varies depending on the house rules, the option allows a player to double the player's wager in exchange for a single additional card. For example, if a player has an initial hand total of ten the player may wish to double down by placing an additional wager equal to the player's initial wager to be dealt a single additional card. The player is not allowed to hit after doubling down.

Similarly, if the player receives a pair, i.e. two cards having the same face value, the player may double his initial wager and "split" the pair. By splitting, the player is allowed to use each card of the pair as a base for a separate hand. For example, if a player were to be dealt a pair of sevens, the player may choose to split the pair and play with two hands each having an seven and an additional dealt card. The player may the play the hand to completion by hitting, standing, or, depending on the house rules, splitting or doubling down.

After all the players have completed their hands, the dealer completes the dealer hand by hitting or standing as the house rules dictate. If the dealer busts, all players who did not bust or receive a Blackjack are rewarded. After completing the dealer's hand, the dealer resolves the wagers. In resolving wagers, players with a final hand total closer to twenty-one than the dealer's final hand total are rewarded, typically at 1:1. Conversely, wagers are collected from players with a final hand total further from twenty-one than the dealer's final hand total. If the player and dealer push, i.e. have the same final hand total, the player's wager is returned.

The drawback to Blackjack, however, is that large payouts are not available. Similarly, Blackjack is a solitary game in which each player is playing separately against the dealer. Thus, the game lacks the team atmosphere that many players enjoy.

Another game that can be dealt quickly is video poker. In the conventional game of video poker known in the art, a gaming device is provided wherein the player makes a wager and the device's processor selects from a data structure containing data representing cards in a deck of playing cards, five cards to be displayed face up to represent an initial hand. The player selects which, if any, of the five cards of the initial hand to hold and prompts the processor to discard the remaining cards. The discarded cards are replaced with replacements selected from the data structure to produce a final hand outcome of a five card Poker hand. The video poker device compares the final outcome to the pre-determined winning combinations also stored in a data structure, these combinations frequently representing ranked Poker hands. If the player's final outcome matches a winning combination, the player is rewarded. Otherwise, the final outcome is deemed to be a loss and the player's wager is retained.

These games, though popular, are becoming commonplace. Also, it is known that many players prefer games, unlike Blackjack and video poker, in which a collegial atmosphere is created. For example, in Craps, all wagers depend on the same roll of the dice. Thus, players betting with the shooter, for example Pass Line bettors, tend to exhibit somewhat of a team spirit during play that is attractive to many players.

Thus, there is a need in the art for a new game in which a high number of hands may be dealt and includes an additional feature that allows a collegial, team atmosphere.

SUMMARY OF THE INVENTION

A method for playing a card game between at least one player and a dealer using at least one standard deck of playing cards begins by providing a playing table having a number of player positions. The player or players occupy the player positions. Optionally, at least four player positions are provided. In a further optional embodiment, six player positions are provided.

Each player makes a first and second wager. The dealer deals one card to each occupied and unoccupied player position and to the dealer. The card at each occupied player position is compared to the dealer card. A reward is issued to a player based on the player's first wager if the player's card outranks the dealer card. If, conversely, the dealer's card outranks the player's card, the player's first wager is collected. In an optional embodiment, the player's wager may be returned if the player's card ties the dealer's card.

In an optional embodiment, an automatically winning card may be provided. In such an optional embodiment, a player receiving the automatically winning card is rewarded based on the player's first wager if the dealer does not have a predetermined automatically winning card. If, conversely, the dealer too has an automatically winning card, the player's first wager is returned, i.e. the player and dealer push.

In another optional embodiment, an insurance wager may be provided in which a player receiving a predetermined card is allowed to place an insurance wager less than the player's first wager. Optionally, the insurance wager is equal to half the player's first wager. If a player making an insurance wager has a player card that is outranked by the dealer card, the player's insurance wager is collected and the player's first wager is returned. If a player making an insurance wager has a player card that outranks the dealer card, the player is rewarded based on the player's first wager.

In yet another optional embodiment of the present game, a supplemental wager may be provided in which a player receiving a predetermined card may place a supplemental wager equal to the player's first wager. If the player's card outranks the dealer's card, the player is rewarded based on the sum of the player's first wager and supplemental wager. If, however, the player's card is outranked by the dealer's card, the player's first wager and supplemental wager are collected.

After resolving the first wagers, a community hand is formed by using the cards dealt to the occupied and unoccupied player positions and the dealer card. Optionally, the community hand is the highest ranking five-card poker hand possible from the dealer and player cards. The community hand is compared to a predetermined schedule of winning hands. If the community hand is a winning hand, a reward is issued to each player based on the player's second wager. For example, in an optional embodiment, players may be rewarded if the community hand is a straight, flush, full house, straight flush, four of a kind, five of a kind, or royal flush. If the community hand is not a winning hand, the player's second wager is collected.

In an optional embodiment, the dealer may deal two cards, a first card and a second card, to himself or herself as explained below. As above, the player card at each occupied player position is compared to the first dealer card and a reward is issued to a player based on the player's first wager if the player's card outranks the first dealer card. As above, optional embodiments may include features such as an automatically winning card, an insurance wager, or supplemental wagers.

As above, after resolving the first wagers, a community hand is formed by using the cards dealt to the occupied and unoccupied player positions and the second dealer card. The community hand is compared to a predetermined schedule of winning hands and a reward is issued based on the player's second wager if the community hand is a winning hand.

DESCRIPTION

Figure 1:
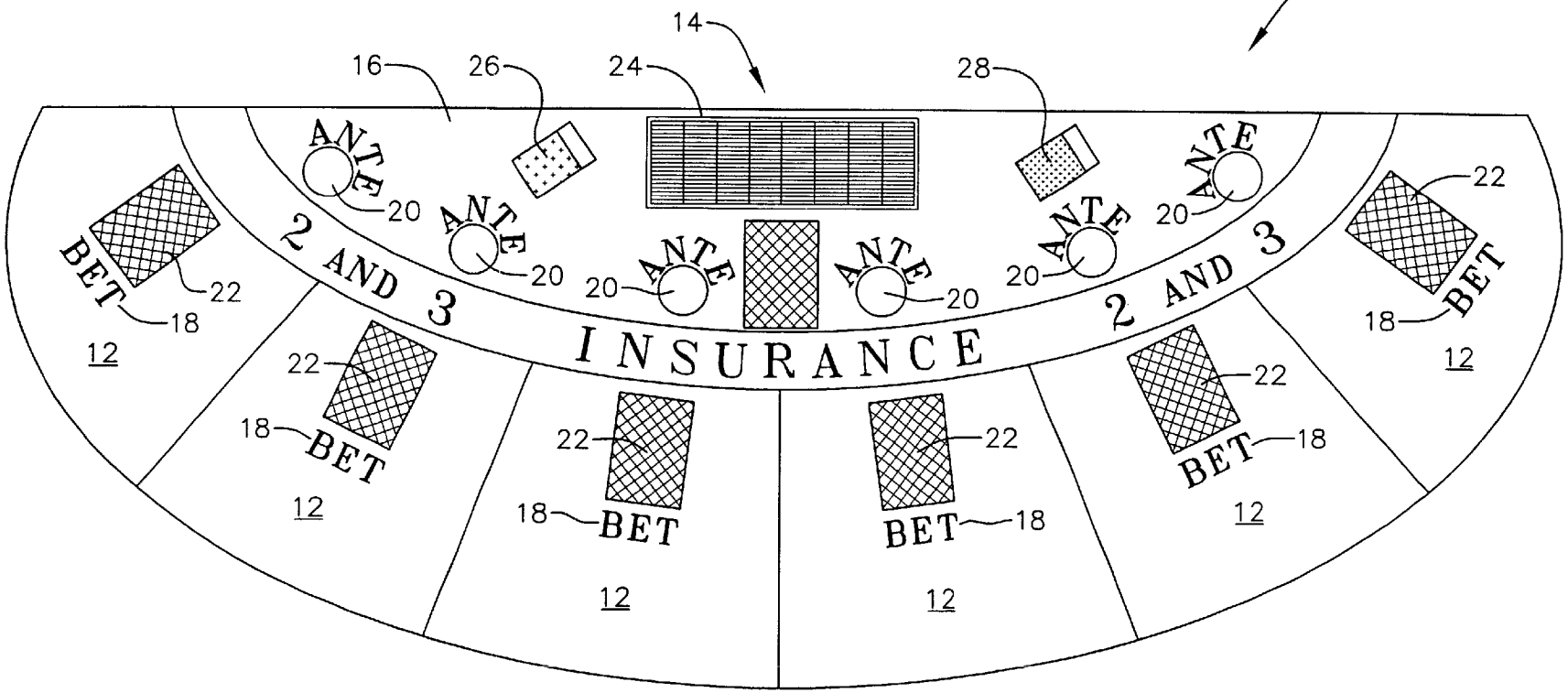
FIG. 1 is a top view of a layout according to an embodiment of the present invention.

Reference is now made to the figures wherein like parts are referred to by like numerals throughout. Referring to FIG. 1, the game method of the present invention is played on a gaming table 10 having a plurality of player positions 12 and a dealer position 14. The table 10 of the present invention includes at least four player positions 12. According to an optional embodiment, the table 10 includes six player positions 12. The gaming table 10 optionally includes a layout 16 indicating two betting areas 18, 20 for each player position 12 and areas 22 to which cards may be dealt for each player and the dealer. The table may also include a chip rack 24 for holding gaming chips, a shoe 26 from which playing cards are dealt, and a discard rack 28 for discarded cards. The game is played using at least one standard deck of cards; optionally several decks of cards may be used. Also, the Jokers may be included or excluded as desired.

Figure 2:
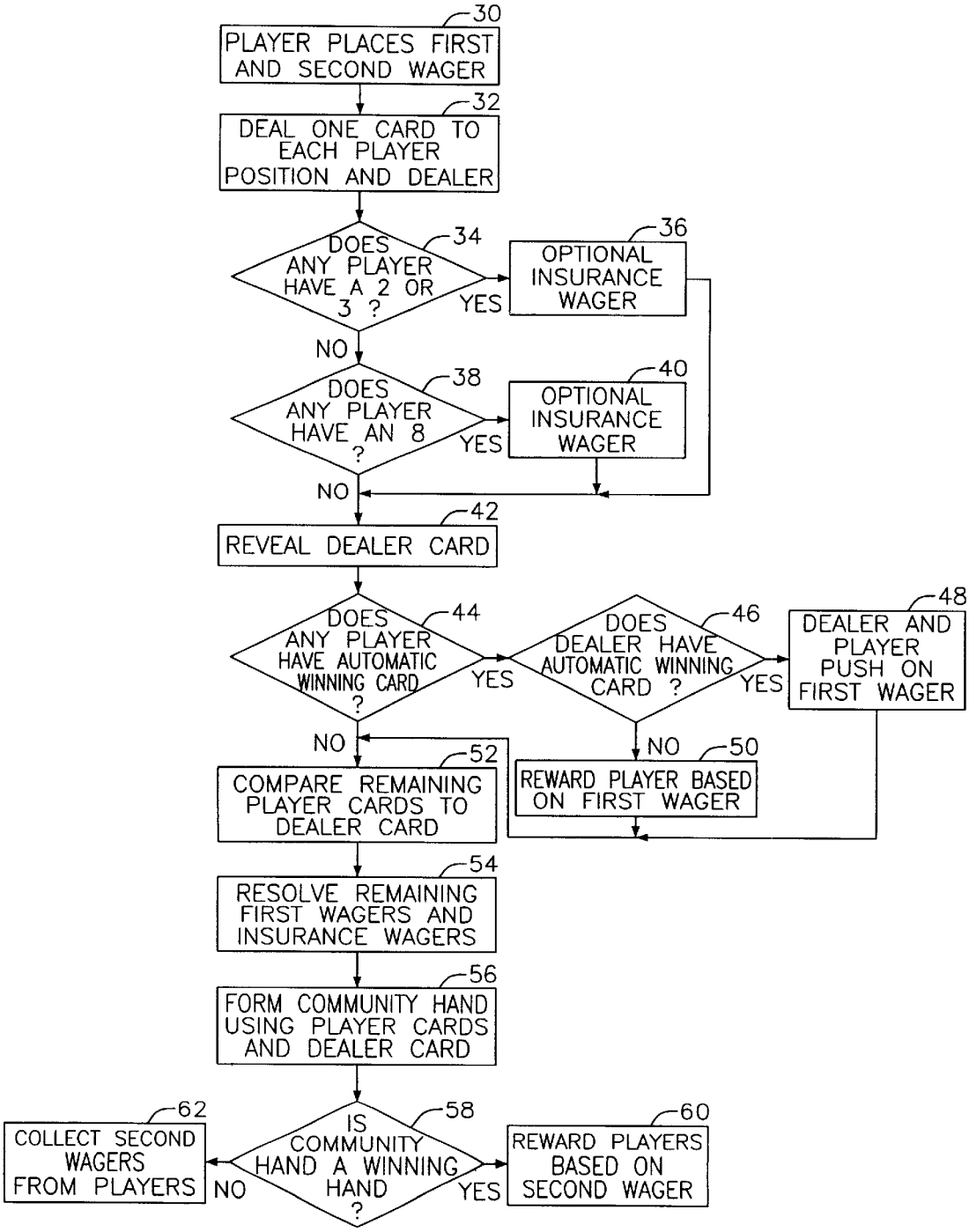
FIG. 2 is a flowchart of an embodiment of the game method of the present invention.
Figure 3:
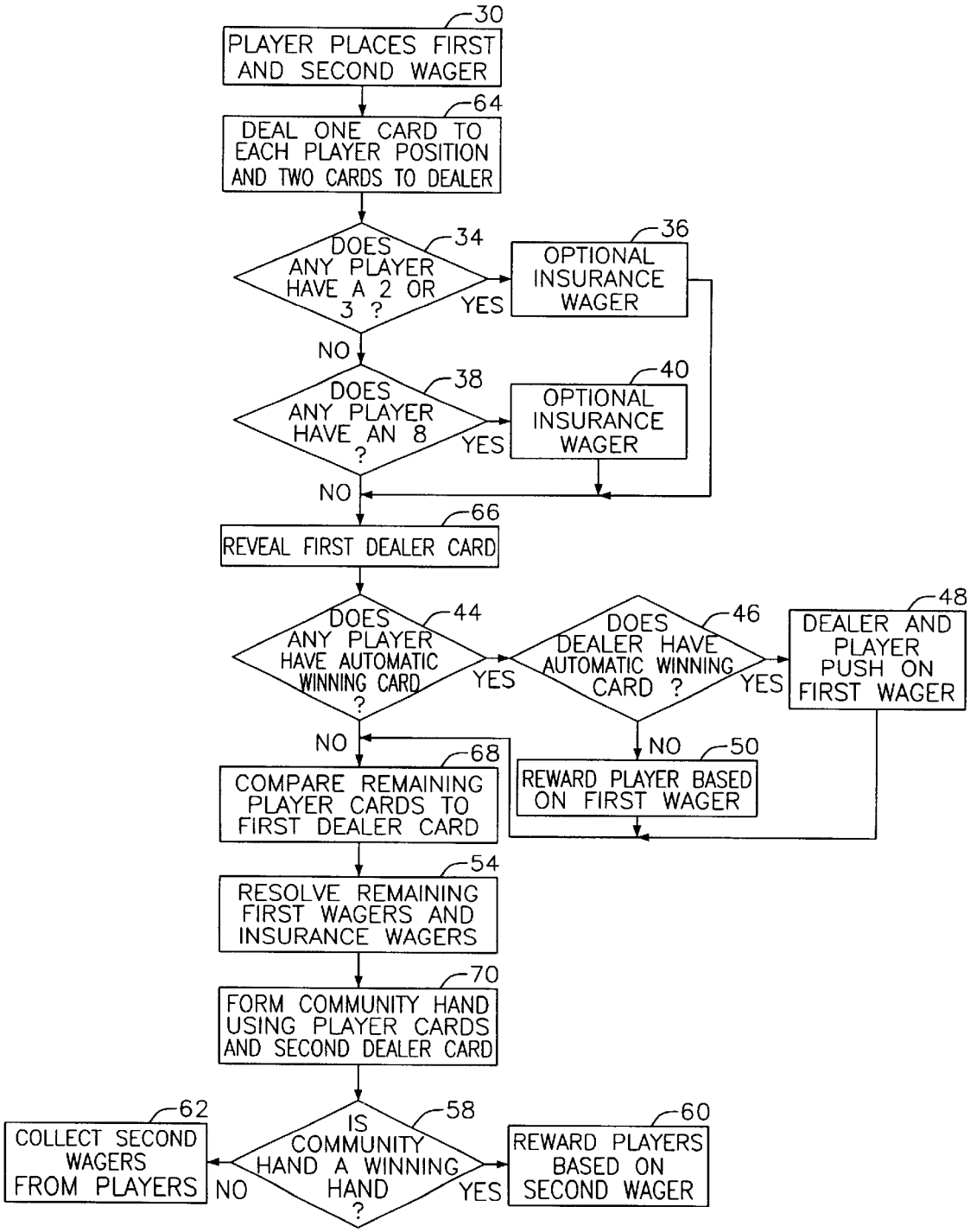
FIG. 3 is a flowchart of an alternate embodiment of the game method of the present invention.

Referring to FIGS. 2 and 3, the game of the present invention is played between a dealer and at least one player occupying a player position 12. Play of the game begins with a player making a first and second wager 30 by placing a quantity of gaming chips at the betting areas 18, 20. It is important to note that not all of the player positions 12 must be occupied. In fact, during play of the game, the dealer deals one card 32 to each player position 12 without regard to whether the player position 12 is occupied. That is, a dealer dealing at the table 10 shown in FIG. 1 deals a card 32 to each player position 12 for a total of six player cards regardless of the number of players playing or the number of player positions 12 occupied. The dealer also deals at least one card 32, 64 to the dealer position 14. More specifically, in the optional embodiment shown in FIG. 2, the dealer deals one card 32 to the dealer position 14; in an alternate embodiment discussed below and shown in FIG. 3, the dealer deals a first card and a second card 64 to the dealer position 14. The dealer card(s) are dealt 32, 64 face down.

Referring to FIG. 2, having dealt 32 one card to each player position 12 and one card to the dealer position 14, the dealer resolves 54 each player's first wager by revealing 42 the dealer card and comparing 52 the dealer card to the player card at each occupied player position. A player is rewarded based on his first wager if the player's card outranks the dealer card. Conversely, if the dealer card outranks the player's card, the player's first wager is collected. If the player's card and dealer card push, i.e. tie, the player's first wager is returned. In an optional embodiment, conventional playing card rankings are used. That is, cards are serially ranked from deuce to Ace based on their face value. In an optional alternate embodiment, special rankings may be instituted. For example, in such an optional alternate embodiment, deuces may outrank Aces but lose to all other cards.

Similarly, an automatically winning card may be provided. The automatically winning card could be any card or set of cards in the deck of cards. In such an optional embodiment, when a player receives 44 an automatically winning card, the dealer determines 46 whether the dealer's card, too, is an automatically winning card. A player receiving an automatically winning card wins 50 against any dealer card except another automatically winning card. However, if the dealer also has an automatically winning card, the player and dealer push 48. For example, if red Jacks are selected to be the automatically winning card, the player hand J♡ wins against a dealer hand A♣ but pushes against a dealer hand J♢ or J♡. Optionally, a player having an automatically winning card may be paid at greater than even money. For example, in one embodiment, a player may be rewarded at 1.5:1.

In another optional embodiment, players may optionally adjust their first wagers after the cards are dealt but before the dealer reveals his card and resolves the first wagers.

Specifically, an insurance wager may be provided in which a player receiving 34 a predetermined holding, such as a deuce or three, may place an additional insurance wager 36 to hedge against losing. For example, in such an optional embodiment, a player having a deuce or three 34 may place an insurance wager 36 equal to fifty-percent of the player's first wager. In resolving insurance wagers, if the player loses against the dealer, i.e. the player's card is outranked by the dealer card, the dealer collects the player's insurance wager but returns the player's first wager.

Similarly, an opportunity to make a supplemental wager 40 may also be provided in an optional embodiment. In such an optional embodiment, a player having a predetermined holding 38, such as an eight, may place a supplemental wager 40, the size of which is defined by house rules. For example, in such an optional embodiment, a player having an eight 38 may place a supplemental wager 40 equal to the player's first wager. If the player wins against the dealer, i.e. the player's card outranks the dealer card, the player is rewarded based on the sum of the player's first wager and supplemental wager. If the player loses against the dealer, the player's first wager and supplemental wager are collected.

After resolving 54 all first wagers, a community hand is formed 56 using the cards dealt to all the player positions and the dealer card. That is, all player cards are used in the community hand 56 regardless of whether the player position is occupied. For example, even if only two player positions are occupied at the table of FIG. 1, all six cards dealt to player positions 12 are combined with the dealer card to form a community hand 56. Optionally the community hand 56 is the highest ranking five card poker hand possible from the player and dealer cards. The community hand 56 is compared 58 to a predetermined schedule of winning hands. If the community hand 56 is a winning hand, every player is rewarded 60 based on the player's second wager. If the community hand 56 is not a winning hand, the players' second wagers are collected 62. While any hand could be rewarded 60, in an optional embodiment, the following community hands 56 are rewarded 60: straight, flush, full house, four of a kind, five of a kind, straight flush, and royal flush. In such an embodiment, the following optional pay table could be used:

TABLE 1

| Community Hand | Payout |
|---|---|
| Flush | 3:1 |
| Straight | 4:1 |
| Full House | 5:1 |
| Four of a Kind | 6:1 |
| Five of a Kind | 7:1 |
| Straight Flush | 8:1 |
| Royal Flush | 100:1 |

For example, if the following cards are dealt 32 to the player positions: 4♠ 2♢ 6♣ 8♢ 6♡ 3♠, and the dealer is dealt 32 a 5♣. For the purposes of the example, it is assumed that only the first, second, third, and fourth player positions 12 are occupied. In an optional embodiment, the player at the second position has received 2♢ and is allowed to make an insurance wager 36 if desired. Similarly, in an optional embodiment, the player at the fourth position has received 8♢ and, thus, is allowed to make a supplemental wager 40 if desired. After wagers are adjusted, the dealer reveals 42 his card and resolves 54 each first wager by comparing the dealer card to each player's card. The dealer card (5♣) outranks the first (4♠) and second (2♢) player cards and, thus, the first and second players' first wagers are collected. However, the third (6♣) and fourth (8♢) player cards outrank the dealer card (5♣). Thus, the third and fourth players are rewarded based on their first wager or, if exercised, their first wager plus supplemental wager. After resolving 54 each player's first wager, the dealer resolves the second wagers by forming a community hand 56 using all the cards dealt without regard to whether the card was used in the first phase of the game. Thus, the community hand 56 of the example is formed from 4♣ 2♢ 6♣ 8♢ 6♡ 3♠ 5♣. In the embodiment in which the community hand 56 is the highest ranking five card poker hand possible, the community hand 56 could consist of 2♢ 3♠ 4♠ 5♣ 6♣ to form a straight. This holding is compared 58 to a predetermined schedule of winning hands. If the optional paytable of Table 1 is used, each player is rewarded 60 based on the player's second wager without regard to whether the player's card was used to form the final community hand 56. Thus, in the present example, all players are rewarded at 4:1.

Referring to FIG. 3, in an alternate embodiment, the dealer deals 64 one card to each player position and two cards, a first and second card, to the dealer position. The dealer resolves 54 each player's first wager by revealing 64 the first dealer card and comparing 68 the first dealer card to the player card at each occupied player position. A player is rewarded based on his first wager if the player's card outranks the first dealer card. Conversely, the player's first wager is collected if the first dealer card outranks the player's card. Once again, optional features such as an automatically winning card 44, insurance wagers 36, and supplemental wagers 40 may be provided. In an optional embodiment, the first dealer card may be removed to the discard rack 28 after all first wagers are resolved 54 to prevent confusion during the second stage of the game.

After resolving 54 all first wagers, a community hand 70 is formed using the cards dealt to the player positions and the second dealer card. Once again, the community hand 58 is compared to a predetermined schedule of winning hands. If the community hand is a winning hand, every player is rewarded 60 based on the player's second wager. If the community hand is not a winning hand, the players' second wagers are collected 62.

For example, if the following cards are dealt 64 to the player positions: 8♡ 4♣ K♣ 4♢ 10♣ 7♣, and the dealer receives 3♠ 5♣. Because the first player has a holding (8♡) eligible for a supplemental wager, the first player may opt to supplement his first wager before the dealer resolves the first wagers. In resolving 54 the first wagers, the first dealer card (3♠) is compared 68 to each player card. In the example, the first dealer card is outranked by every player card. Thus, each player is rewarded based on the player's first wager or, if elected, the player's first wager plus supplemental wager. In resolving the second wagers, only the second dealer card 5♣ is used in conjunction with player cards 8♡ 4♣ K♣ 4♣ 10♣ 7♣ to form a community hand 56. In the embodiment in which the community hand is the highest ranking five card poker hand possible, the community hand could consist of 4♣ K♣ 10♣ 7♣ 5♣ to form a flush. This holding is compared to the predetermined schedule of winning hands. If the optional Table 1 shown above is used, each player is rewarded 60 based on the player's second wager without regard to whether the player's card was used to form the final community hand 70. Thus, in the present example, all players are rewarded at 3:1.

While certain embodiments of the present invention have been shown and described it is to be understood that the present invention is subject to many modifications and changes without departing from the spirit and scope of the claims presented herein.

I claim:

1. A method for playing a card game between at least one player and a dealer using at least one standard deck of playing cards, comprising:

providing a playing table having a plurality of player positions, at least one of said player positions occupied by a player;

each player making a first and second wager;

dealing one card to each occupied and unoccupied player position and to the dealer;

comparing the card at each occupied player position to the dealer card and rewarding the player based on the player's first wager if the player's card outranks the dealer card or collecting the player's first wager if the dealer's card outranks the player's card;

forming a community hand using the cards dealt to the occupied and unoccupied player positions and the dealer card; and comparing the community hand to a predetermined schedule of winning hands and rewarding each player based on the player's second wager if the community hand is a winning hand, otherwise collecting each player's second wager.

2. The method of claim 1 wherein a player receiving a predetermined automatically winning card is rewarded based on the player's first wager if the dealer does not have a predetermined automatically winning card, otherwise the player's first wager is returned.

3. The method of claim 1 further comprising:

if a player receives a predetermined card, the player placing an insurance wager less than the player's first wager; and collecting the player's insurance wager and returning the player's first wager if a player making an insurance wager has a player card that is outranked by the dealer card, otherwise rewarding the player based on the player's first wager.

4. The method of claim 1 further comprising:

if a player receives a predetermined card, the player placing a supplemental wager equal to the player's first wager; and rewarding a player making a supplemental wager based on the sum of the player's first wager and supplemental wager if the player's card outranks the dealer's card, otherwise collecting the player's first wager and supplemental wager.

5. A method for playing a card game between at least one player and a dealer using at least one standard deck of playing cards, comprising:

providing a playing table having a plurality of player positions, at least one of said player positions occupied by a player;

each player making a first and second wager;

dealing one card to each occupied and unoccupied player position;

dealing a first and second card to the dealer;

comparing the card at each occupied player position to the dealer's first card and rewarding the player based on the player's first wager if the player's card outranks the dealer's first card or collecting the player's first wager if the dealer's first card outranks the player's card;

forming a community hand using the cards dealt to the occupied and unoccupied player positions and the dealer's second card; and comparing the community hand to a predetermined schedule of winning hands and rewarding each player based on the player's second wager if the community hand is a winning hand, otherwise collecting the player's second wager.

6. The method of claim 5 wherein a player receiving a predetermined automatically winning card is rewarded based on the player's first wager if the dealer does not have a predetermined automatically winning card, otherwise returning the player's first wager.

7. The method of claim 5 further comprising:

if a player receives a predetermined card, the player placing an insurance wager less than the player's first wager; and collecting the player's insurance wager and returning the player's first wager if a player making an insurance wager has a card that is outranked by the dealer card, otherwise rewarding the player based on the player's first wager.

8. The method of claim 5 further comprising:

if a planer receives a predetermined card, the player placing a supplemental wager equal to the player's first wager; and rewarding a player making a supplemental wager based on the sum of the player's first wager and supplemental wager if the player's card outranks the dealer's card, otherwise collecting the player's first wager and supplemental wager.

9. A method for playing a card game between at least one player and a dealer using at least one standard deck of cards, comprising:

providing a playing table having six player positions, at least one of the player positions occupied by a player;

each player making a first and second wager;

dealing one card to each occupied and unoccupied player position and to the dealer;

comparing the card at each occupied player position to the dealer card and (a) rewarding the player based on the player's first wager if the player's card outranks the dealer card, (b) returning the player's first wager if the player's card ties the dealer card, or (c) collecting the player's first wager if the dealer's card outranks the player's card;

forming the highest ranking, five-card community poker hand possible using the six cards dealt to the player positions and the dealer card; and comparing the community poker hand to a predetermined schedule of winning hands and rewarding each player based on the player's second wager if the community poker hand is a winning hand, otherwise collecting the player's second wagers.

10. The method of claim 9 wherein a player receiving a predetermined automatically winning card is rewarded based on the player's first wager if the dealer does not have a predetermined automatically winning card, otherwise returning the player's first wager.

11. The method of claim 10 wherein a player receiving a predetermined automatically winning card is rewarded at greater than one to one.

12. The method of claim 9 further comprising:

if a player receives a predetermined card, the player placing an insurance wager equal to one half the player's first wager; and collecting the player's insurance wager and returning the player's first wager if a player making an insurance wager has a card that is outranked by the dealer card, otherwise rewarding the player based on the player's first wager.

13. The method of claim 9 further comprising:

if a player receives a predetermined card, the player placing a supplemental wager equal to the player's first wager; and rewarding a player making a supplemental wager based on the sum of the player's first wager and supplemental wager if the player's card outranks the dealer's card, otherwise collecting the player's first wager and supplemental wager.

14. The method of claim 9 wherein the players are rewarded based on their second wagers if the community poker hand is a straight, flush, full house, four of a kind, five of a kind, straight flush, or royal flush.

* * * * *